US009259600B2

(12) United States Patent
Cropper

(10) Patent No.: US 9,259,600 B2
(45) Date of Patent: Feb. 16, 2016

(54) METHOD AND APPARATUS FOR PROTECTING BUILDINGS FROM FIRE

(76) Inventor: Graig Cropper, Orem, UT (US)

( * ) Notice: Subject to any disclaimer, the term of this patent is extended or adjusted under 35 U.S.C. 154(b) by 1240 days.

(21) Appl. No.: 12/556,434

(22) Filed: Sep. 9, 2009

(65) Prior Publication Data

US 2010/0058695 A1 Mar. 11, 2010

Related U.S. Application Data

(60) Provisional application No. 61/095,586, filed on Sep. 9, 2008.

(51) Int. Cl.
*E04B 1/94* (2006.01)
*A62C 2/10* (2006.01)
*A62C 3/02* (2006.01)

(52) U.S. Cl.
CPC ..... *A62C 2/10* (2013.01); *A62C 3/0214* (2013.01); *A62C 3/0257* (2013.01); *E04B 1/94* (2013.01)

(58) Field of Classification Search
CPC ..... E04G 21/28; A62C 2/10; A62C 3/0257; A62C 3/0214; A62C 3/02; E04B 1/94
USPC ..... 52/506.05, 3, 5, DIG. 14, DIG. 12; 169/48
See application file for complete search history.

(56) References Cited

U.S. PATENT DOCUMENTS 3,253,978 A 5/1966 Bodendorf et al.
3,766,958 A * 10/1973 Mitchell ..... 160/84.02
4,397,122 A * 8/1983 Cros ..... 52/3
4,494,295 A * 1/1985 Herring ..... 29/432
4,522,673 A 6/1985 Fell et al.
4,622,251 A * 11/1986 Gibb ..... 428/359
4,650,621 A 3/1987 Sago et al.
4,858,395 A * 8/1989 McQuirk ..... 52/3
4,926,963 A 5/1990 Snyder
5,273,096 A * 12/1993 Thomsen et al. ..... 160/84.01
5,273,821 A 12/1993 Olson et al.
5,608,992 A * 3/1997 Floyd ..... 52/3
5,679,433 A 10/1997 Hayashi et al.
5,759,659 A 6/1998 Sanocki et al.
5,829,200 A * 11/1998 Jones et al. ..... 52/3
5,860,251 A * 1/1999 Gleich ..... 52/2.25
5,945,049 A 8/1999 Vandermeer
5,955,177 A 9/1999 Sanocki et al.
6,153,674 A 11/2000 Landin
6,474,022 B1 * 11/2002 Double et al. ..... 52/3
6,521,834 B1 2/2003 Dykhoff et al.
6,533,897 B2 3/2003 Wang et al.
6,551,951 B1 4/2003 Fay et al.
6,742,305 B2 * 6/2004 Rogers et al. ..... 52/3
6,810,626 B2 * 11/2004 Meyer et al. ..... 52/1

(Continued)

OTHER PUBLICATIONS

O.A. Battista, Synthetic Fibers in Papermaking, ca. Aug. 26, 1976.

*Primary Examiner* — Adriana Figueroa
*Assistant Examiner* — Jessie Fonseca
(74) *Attorney, Agent, or Firm* — Pate Peterson PLLC; Brett Peterson

(57) ABSTRACT

A fire barrier for buildings includes a ceramic fiber based material such as ceramic paper. The ceramic prevents the burning of the building in case of a fire. The ceramic material may be mounted to the building on spools prior to use and rapidly deployed therefrom in the event of a fire near the building.

14 Claims, 4 Drawing Sheets

(56) References Cited

U.S. PATENT DOCUMENTS

| | | | | |
|---|---|---|---|---|
| 6,820,373 | B1 * | 11/2004 | Bundy et al. | 52/1 |
| 7,117,917 | B2 * | 10/2006 | Allsopp | 160/84.04 |
| 7,395,869 | B2 * | 7/2008 | Schnabel et al. | 169/48 |
| 7,578,100 | B2 * | 8/2009 | Sicurella | 52/4 |
| 7,686,094 | B2 * | 3/2010 | Kleff | 169/50 |
| 7,717,187 | B1 * | 5/2010 | Miller et al. | 169/45 |
| 8,146,298 | B2 * | 4/2012 | Bush et al. | 52/23 |
| 2004/0035059 | A1 * | 2/2004 | Meyer et al. | 52/1 |
| 2004/0074152 | A1 * | 4/2004 | Rogers et al. | 52/3 |
| 2004/0187420 | A1 * | 9/2004 | Bernardi et al. | 52/410 |
| 2008/0000648 | A1 * | 1/2008 | Kleff | 169/48 |
| 2008/0217028 | A1 * | 9/2008 | Crumpton | 169/48 |
| 2009/0084047 | A1 * | 4/2009 | Williams | 52/169.14 |

* cited by examiner

METHOD AND APPARATUS FOR PROTECTING BUILDINGS FROM FIRE

PRIORITY

The present application claims the benefit of U.S. Provisional Application Ser. No. 61/095,586, filed on Sep. 9, 2008, which is herein incorporated by reference in its entirety.

THE FIELD OF THE INVENTION

The present invention relates to a method and apparatus for protecting buildings from fire. More specifically, the present invention relates to a ceramic fire barrier suitable for installation on the exterior of buildings to protect the buildings from external fire, such as forest fires or the like.

BACKGROUND

Currently, fires damage a significant number of buildings each year. In some areas, periodic forest or grass fires are common and these fires destroy many buildings. The close proximity of houses and other buildings often causes fires to spread quickly from building to building. While some building materials such as concrete are not burned by fire, other building materials such as plywood sheathing are readily burned by fire. The readiness with which common building materials such as plywood burn causes the fires to spread quickly from building to building, and can make the fire difficult to contain as there is a large source of fuel for the fire.

It would be desirable to improve the fire protection which is available for buildings and especially for houses and residential structures as these are often affected by periodic fires. It would be desirable to provide a fire protection device which may be quickly deployed to protect a building in case of an impending fire. Protecting a house from a fire not only protects the house from damage, but also removes a source of fuel from the fire and thereby diminishes the strength of the fire. If sufficient numbers of buildings employ such a fire protection device, a fire could be much more easily controlled and extinguished as it would lack fuel.

Existing fire barriers for houses suffer from drawbacks. One such drawback is the inability to withstand high wind. Some existing fire barriers are constructed with coverings such as covered frames that extend over a house to enclose the house. It has been found that, in many cases, these frames and coverings were unable to withstand the high winds that are often associated with a fire. In some cases, these products made the fire more damaging to the building. Other fire protection devices rely on water or other consumable goods to combat a fire, and require a dispensing system to control the application thereof. These may fail where the supply of the consumable goods is exhausted, where the strong winds that associated with the fire prevent the distribution thereof, or where the fire renders the control system or communication lines necessary thereto inoperative.

There is a need for a more effective fire barrier for buildings. There is a need for a fire barrier which protects a building from burning in a fire. There is a need for a fire barrier which is durable and which is not easily damaged by the high winds and other forces encountered during a fire. There is also a need for a fire barrier which is easily adapted to any building and which does not require specialized building construction.

SUMMARY OF THE INVENTION

It is an object of the present invention to provide an improved fire barrier.

According to one aspect of the invention, a fire barrier is provided which uses sheets of ceramic fiber based material to cover the outsides of a building. The ceramic material may be a ceramic paper as is disclosed in U.S. Pat. No. 6,533,897, which is expressly incorporated herein. The ceramic paper remains stable in very high temperatures and may be used to prevent or inhibit underlying structures from burning. The present invention does not rely on a consumable fire combatant such as water or the like. "Paper" refers to a fibrous product produced by one of a number of paper making processes. Typically, the paper is a compressed mat-type product rather than a woven product. "Paper making process" is any process wherein the aluminosilicate refractory fibers (with or without other components) are pulped, compressed, and dehydrated. Specifically, the noncombustible fibrous papers of the present invention can comprise a dominant amount of aluminosilicate refractory fibers by weight. Typically, this will be from about 90% to 99.8% by weight. Additionally, the fibers used can be substantially from 1 micron to 35 microns in width and from 1 cm to 15 cm in length. Further, the aluminosilicate refractory fibers can comprise from 30% to 70% silica by weight and from 70% to 30% alumina by weight. However, in many instances, the silica and the alumina are present in substantially equal proportions by weight. Anywhere from about 0.2% to 4% by weight of a polymeric binder distributed throughout the paper can be used. Though not required, the paper can also include from 0.1% to 5% by weight of a textile filler. Any known textile filler can be used such as, for example, viscose fiber. Further, the noncombustible paper can also comprise from 0.2% to 5% by weight of silicic acid aquagel. For example, though any functional thickness can be prepared, from 0.3 mm to 3.0 mm of thickness is preferred. The weight can be any functional weight, though from 50 to 300 g per square meter is preferred. An example paper may have a density between 180 and 240 kg per cubic meter.

According to another aspect of the present invention, a fire barrier is provided which may be easily and reliably attached to a building. The fire barrier accommodates most types of exterior building finishes, and thus may be attached to most buildings. The fire barrier is durable and able to withstand mechanical stresses such as are caused by the wind associated with a fire.

These and other aspects of the present invention are realized in a fire barrier as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
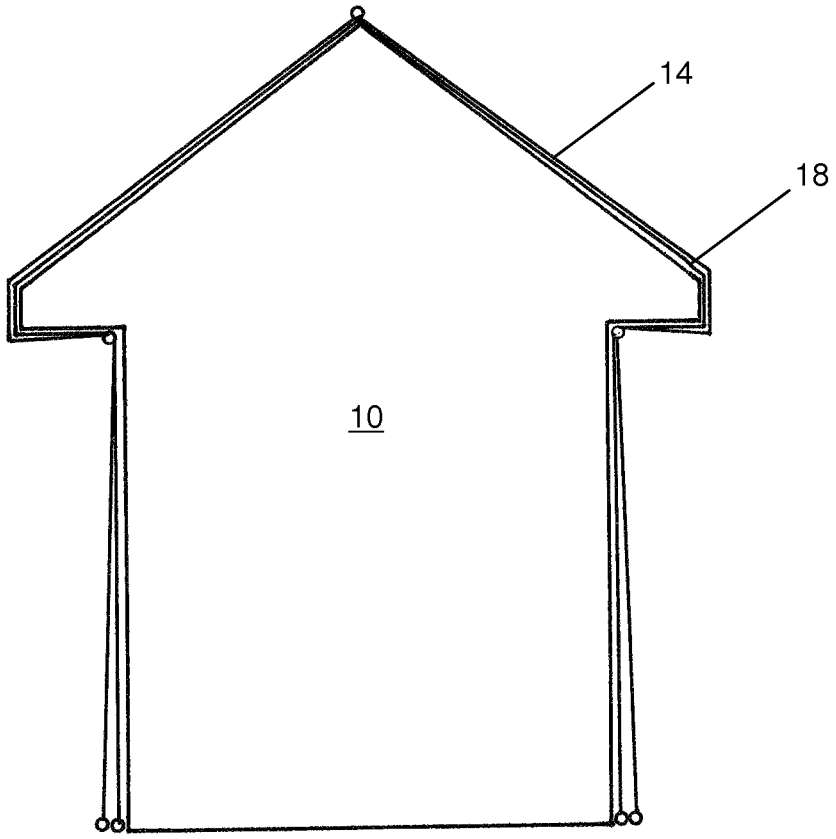
FIG. 1 shows an end view of a house having a fire barrier according to the present invention.

Turning now to FIG. 1, an end view of a house with a fire barrier according to the present invention is shown. Although a residence such as a house is shown, it will be appreciated that the fire barrier may be used with many types of buildings. The house 10 has been covered with a ceramic fiber based covering 14. The ceramic covering 14 may preferably be a ceramic paper such as is discussed in U.S. Pat. No. 6,533,897. The ceramic covering 14 can withstand temperatures of 1400° C. or more without degrading, and is thus highly resistant to fires. The ceramic covering 14 also impedes heat transfer, and serves to protect the house 10 from the temperature of a fire. If desired, an additional insulation layer 18 may be placed between the house 10 and the ceramic layer 14 to further protect the house from the heat.

Typically, rolls of the covering are used to cover the house, leaving joints between the lengths of covering. These joints are held closed, and the covering is fastened to the house. The ceramic covering 14 may be attached to the house 10 as described in the following figures and paragraphs. Because the covering 14 is attached directly to the house 10, it is held secure. The present invention does not rely on a covering frame as in prior art fire barriers, and is thus quite resistant to winds as the house 10 is able to withstand high winds.

Figure 2:
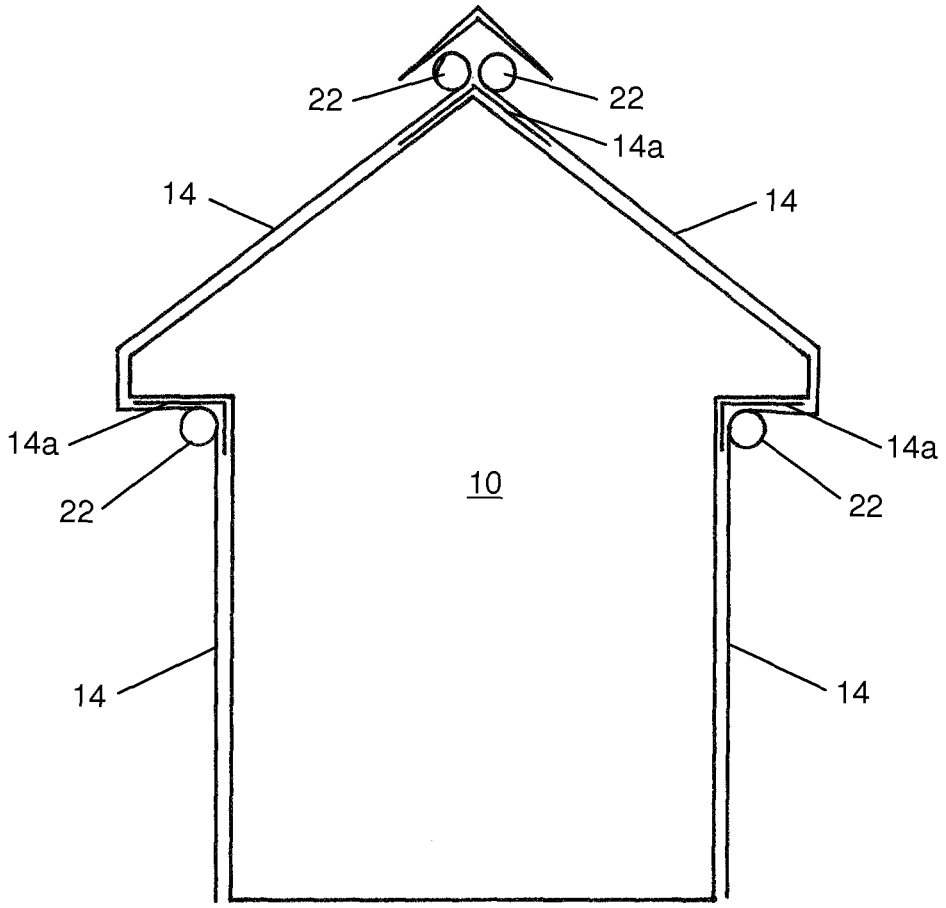
FIG. 2 shows another end view of a house having a fire barrier according to the present invention.

Turning now to FIG. 2, another end view of a house is shown. The house 10 has been covered with a ceramic covering 14. The ceramic covering 14 is stored in rolls 22 which are mounted to the house 10. The rolls 22 are mounted to the house 10 such that the rolls can rotate easily to dispense the ceramic covering therefrom. To cover the house 10 with the ceramic covering 14, a person would simply grasp the end of the ceramic covering on one of the rolls 22 and pull the covering outwardly or downwardly to cover the associated portion of the house.

Having rolls 22 of the ceramic covering 14 permanently mounted to the house is advantageous in areas where forest fires are common as the homeowner need not worry about locating a suitable fire barrier when a fire is approaching and because the ceramic covering 14 may be extended to cover the house quite quickly in case of an emergency. Typically, a ceramic covering 14 would extend over the roof of the house and around and underneath the eaves and down the walls of the house. As shown, the sections of ceramic covering may extend from the peak of the roof to cover the roof and eaves and from the eaves to the base of the walls.

Small sections of ceramic covering 14*a* may be placed at the peak and eaves of the house to ensure adequate covering of the house at the joints between the ceramic covering 14. These smaller sections of ceramic covering 14*a* would typically be permanently attached to the exterior of the house 10 in the positions shown. They may be colored so as to not detract from the house visually. The rolls of covering 22 may also be colored to match the house 10 or may be covered with a colored cover when not in use so as to not detract visually from the appearance of the house.

The ceramic covering 14 of FIG. 2 would be attached together and to the house as described in the following figures and paragraphs. While not shown for clarity, a layer of insulating material 18 may be used as shown in FIG. 1.

Figure 3:
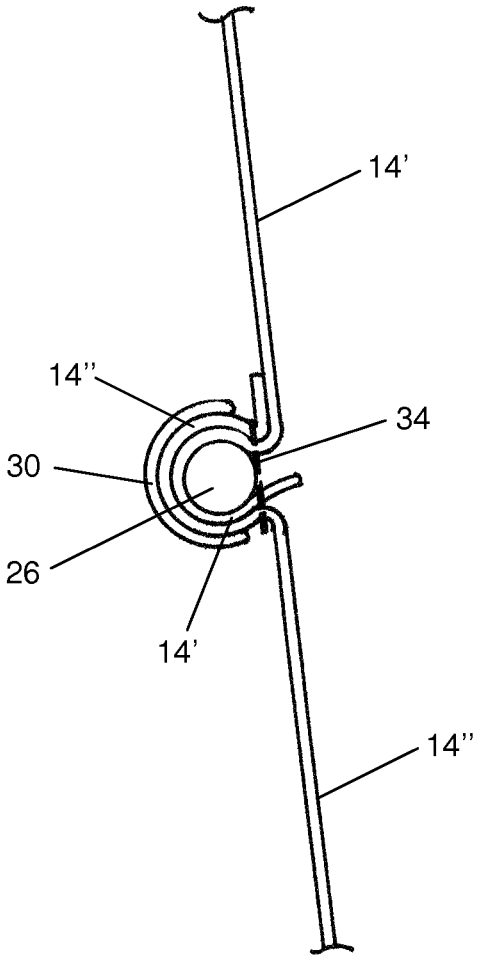
FIG. 3 shows an end view of a seam as may be used with the present invention.

Turning now to FIG. 3, an end view of a seam used to join adjacent sections of ceramic covering is shown. It will be appreciated that ceramic materials such as ceramic paper are available in limited widths, and typically are not available in rolls wide enough to cover an entire wall of a house. Furthermore, it may often be too difficult to handle and apply an overly wide piece of ceramic material, particularly in an emergency where time and manpower may be limited. It is thus necessary to join adjacent sections of the ceramic covering 14. While panels of ceramic paper or the like may be sewn together in a manner similar to cloth, this is typically too time consuming and difficult to accomplish when installing a fire barrier on a house. A joint may thus be made by partially wrapping a first section of ceramic covering 14' and a second section of ceramic covering 14" around a rod 26. Preferably, the rod 26 is a ceramic rod or rope so as to be fire resistant, although some metals may work. A clip 30 may then be placed over the rod 26 to attach the ceramic coverings to the rod. The clip 30 may typically be a ceramic clip or a metal clip which would not be destroyed by exposure to fire.

Additionally, the ceramic covering 14' and 14" may be sewn around the rod 26 by a fire proof cord 34, such as a ceramic cord. Because the rod 26 gives strength to the ceramic coverings 14' and 14" and helps keep the ceramic coverings together, it is not necessary to stitch the ceramic coverings together with small stitches such as with clothing, but the cord 34 may loop around the rod 26 every few inches and pass through the ceramic coverings 14' and 14" to attach the ceramic coverings to the rod 26 and to each other. The pieces of ceramic covering 14' and 14" are thus quickly and reliably attached together in a manner which will secure the covering 14' and 14" against wind and fire.

Figure 4:
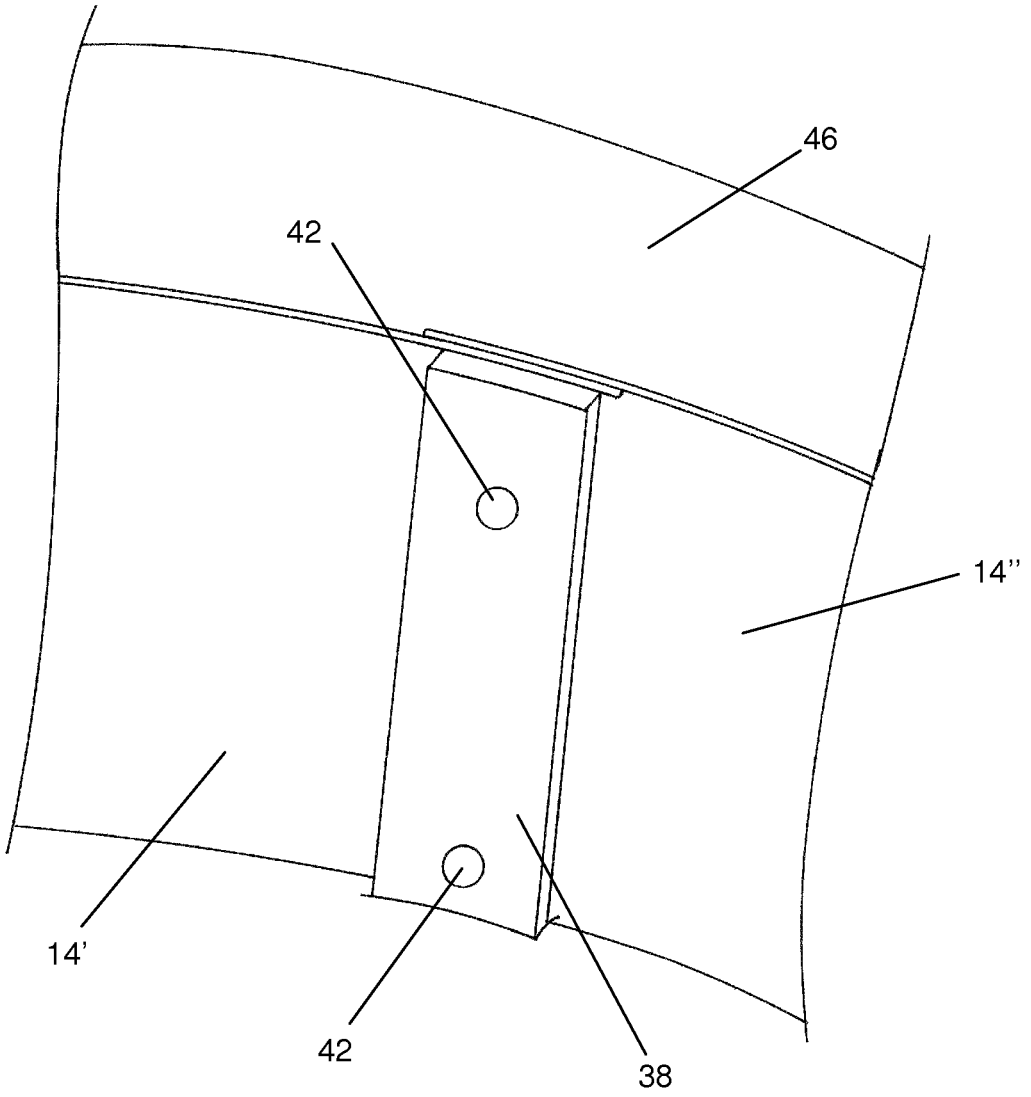
FIG. 4 a partially cut-away perspective view of a fire barrier according to the present invention.

Turning now to FIG. 4, a partially cut-away perspective view of a joint and fastening method of the present invention is shown. When installing a ceramic covering 14 over a house 10, it is desirable to periodically fasten the covering directly to the house. As discussed, strong winds are typically present during a fire and these winds have been shown to damage and disable various fire coverings for houses. Fastening the ceramic covering 14 to the house helps to prevent damage to the covering by the wind and fire. The ceramic covering 14 may be fastened to the house by using a ceramic batten strip 38 and fasteners 42 such as nails or screws to secure the covering to a house wall or roof 46. The batten strip 38 may also be used to join adjacent sections of ceramic covering 14' and 14". The sections of ceramic covering 14' and 14" are placed against the wall in an overlapping configuration and the batten strip 38 is placed over the overlapping sections of ceramic covering. Fasteners 42 are then driven through the batten strip, ceramic covering, and into the wall or roof 46 at regular intervals. The batten strips 38 may also be used to fasten the ceramic covering 14 to the house 10 at non-edge locations to further secure the covering against wind and prevent damage to the covering.

The ceramic covering 14 is thus placed to cover the entire house 10. The battens 38 and seams shown in FIGS. 3 and 4 are used in combination as needed to fasten the ceramic covering 14 to the house 10 and to join adjacent sections 14' and 14" of the ceramic covering. Because the assembled ceramic covering 14 does not present any open edges and is fastened to the house at regular intervals, the ceramic covering is quite resistant to damage from strong winds or the like. The ceramic covering 14 serves to insulate the house from elevated temperatures, but more importantly does not burn and protects the house from burning. It is anticipated that where many adjacent houses or buildings use a fire barrier as discussed herein, an approaching fire will be much more easily stopped and extinguished because the fire barriers effectively prevent the buildings from burning and eliminate or reduce the fire's source of fuel.

There is thus disclosed an improved fire barrier for buildings. It will be appreciated that numerous changes may be made to the present invention without departing from the scope of the claims.

What is claimed is:

1. A temporary fire barrier for a building comprising:

a first sheet of fire proof ceramic fiber paper and an adjacent second sheet of fire proof of ceramic fiber paper, the first and second sheets of ceramic fiber paper being placed so as to cover the building;

connectors for connecting together a seam between the adjacent first and second sheets of ceramic fiber paper; and fasteners for directly fastening the first and second sheets of ceramic fiber paper to a finished exterior of the building after the first and second sheets of ceramic fiber paper are placed to cover the finished exterior of the building; and wherein the connectors comprise a joint having a ceramic rod, wherein adjacent first and second ends of the first and second sheets of ceramic fiber paper are placed in an overlapping fashion so that the first sheet of ceramic fiber paper and the second sheet of ceramic fiber paper overlap each other and are wrapped around the ceramic rod, and wherein the overlapping first sheet of ceramic fiber paper and second sheet of ceramic fiber paper are secured to the ceramic rod.

2. The temporary fire barrier of claim 1, wherein the fasteners comprise ceramic batten strips placed over the first and second sheets of ceramic fiber paper and screws or nails extending through the batten strips, through the first and second sheets of ceramic fiber paper, and into the finished exterior of the building.

3. The temporary fire barrier of claim 1, wherein the connectors comprise ceramic batten strips placed over the first and second sheets of ceramic fiber paper and fasteners extending through the batten strips, through the first and second sheets of ceramic fiber paper, and into the finished exterior of the building.

4. The temporary fire barrier of claim 1, wherein the overlapping first sheet of ceramic fiber paper and second sheet of ceramic fiber paper are secured to the ceramic rod by a clip.

5. The temporary fire barrier of claim 4, wherein the joint further comprises stitching to secure the first and second ends of the first and second sheets of ceramic fiber paper to the ceramic rod.

6. The temporary fire barrier of claim 4, wherein the first and second sheets of ceramic fiber paper comprises between about 0.2 and 4 percent binder by weight.

7. The temporary fire barrier of claim 1, wherein the first and second ends of the ceramic fiber paper are secured to the ceramic rod by stitching.

8. The temporary fire barrier of claim 7, wherein the fasteners comprise batten strips and screws or nails for securing the first and second sheets of ceramic fiber paper directly to a finished exterior of the building.

9. The temporary fire barrier of claim 1, further comprising an insulating layer placed between the first and second sheets of ceramic fiber paper and the building.

10. The temporary fire barrier of claim 1, further comprising spools attached to the building, the spools holding the first and second sheets of ceramic fiber paper in a rolled position prior to placement over the building and allowing the first and second sheets of ceramic fiber paper to be extended therefrom to cover the building.

11. The temporary fire barrier of claim 1, wherein the fasteners penetrate the finished exterior of the building.

12. The temporary fire barrier of claim 1, wherein the temporary fire barrier entirely covers the building.

13. The temporary fire barrier of claim 1, wherein the first and second sheets of ceramic fiber paper is attached to the building with the fasteners penetrating the finished exterior of the building.

14. A fire barrier for a building comprising:

a fire proof ceramic fiber material, the ceramic fiber material comprising ceramic fibers;

wherein the ceramic fiber material is temporarily placed over the building so as to cover a finished exterior of the building;

wherein the ceramic fiber material comprises a seam between adjacent sheets of the ceramic fiber material and a connector for connecting the seam together after placement of the adjacent sheets of ceramic fiber material; and wherein the connector comprises a joint having a ceramic rod, wherein adjacent ends of the ceramic fiber material are placed in an overlapping fashion so that a first sheet of ceramic fiber material overlaps a second sheet of ceramic fiber material and the first and second sheets of ceramic fiber material are wrapped around the ceramic rod, and a fastener for securing the adjacent ends of the ceramic fiber material to the ceramic rod.

* * * * *